United States Patent [19]

Hamid

[11] Patent Number: 4,487,025

[45] Date of Patent: Dec. 11, 1984

[54] PASSIVE BOOSTER FOR PUMPING LIQUIFIED GASES

[75] Inventor: Syed Hamid, Duncan, Okla.

[73] Assignee: Halliburton Company, Duncan, Okla.

[21] Appl. No.: 485,805

[22] Filed: Apr. 18, 1983

[51] Int. Cl.[3] ..... F17C 13/00

[52] U.S. Cl. ..... 62/54; 62/53; 62/55; 62/216; 220/85 VS

[58] Field of Search ..... 62/52, 53, 55, 54, 216, 62/222; 220/85 VR, 85 VS

[56] References Cited

U.S. PATENT DOCUMENTS

| | | | |
|---|---|---|---|
| 1,930,731 | 10/1933 | Thompson | 62/53 |
| 2,467,413 | 4/1949 | Wildhack | 62/53 |
| 2,601,763 | 7/1952 | Peff | 62/53 |
| 3,108,636 | 10/1963 | Peterson | 166/42 |
| 3,195,634 | 7/1965 | Hill | 166/308 |
| 3,396,107 | 8/1968 | Hill | 252/8.55 |
| 3,664,422 | 5/1972 | Bullen | 166/283 |
| 3,842,910 | 10/1974 | Zingg et al. | 166/305 R |
| 3,946,572 | 3/1976 | Bragg | 62/50 |
| 4,122,684 | 10/1978 | Clarkson et al. | 62/54 |
| 4,212,354 | 7/1980 | Guinn | 166/303 |

*Primary Examiner*—Ronald C. Capossela
*Attorney, Agent, or Firm*—Joseph A. Walkowski; Thomas R. Weaver

[57] ABSTRACT

The present invention comprises a method and apparatus for maintaining a liquified gas such as $CO_2$ or $N_2$ in a liquid state prior to its introduction into the suction of a positive displacement pump such as is commonly employed in high pressure well stimulation work in the petroleum industry. A heat exchanger, preferably referred to as a passive booster, is placed in the liquified gas feed line between the gas source and the positive displacement pump. Gas is introduced into the shell side of the passive booster from a chamber in the tube side through a variable orifice throttling valve which, through the Joule-Thomson Effect, drops the temperature of the gas in the shell to provide refrigeration for the main liquified gas flow through the tube side of the passive booster. Flow through the variable orifice valve may be controlled manually or automatically. A back pressure valve on the shell side of the passive booster may be employed to prevent solid formation if one is employing liquified $CO_2$, which forms a solid phase at low temperature at normal atmospheric pressure.

19 Claims, 4 Drawing Figures

PASSIVE BOOSTER FOR PUMPING LIQUIFIED GASES

BACKGROUND OF THE INVENTION

It is common practice in the petroleum industry to employ gases such as $CO_2$ or $N_2$ in stimulation and treatment of oil and gas wells, such as in acidizing, fracturing, well cleanout or $CO_2$ flooding. In addition, such a gas may be employed in foaming cement to be employed in cementing operations in a well bore. The gas is transported in low temperature liquified form to the well site in insulated tank trailers, where it is introduced into the suctions of one or more positive displacement pumps (generally referred to as the "primary" pumps) in order to increase the pressure of the liquified gas prior to mixing with cement or a primary treating fluid which may carry various additives. If well treatment involves fracturing the producing formations in the well, the treating fluid may also carry proppants to prevent formation closure after fracturing. The $CO_2$ or $N_2$ provides a gaseous phase in the treating fluid upon increase in temperature and decrease in pressure in the formation, which gas is highly beneficial to the treatment in that it reduces the amount of treating fluid and additives required, provides a light weight carrier medium for proppants, and places less stress on the producing formation than a heavier, unfoamed treating fluid. In a similar manner, foamed cement is employed when a heavier cement may be deleterious to the producing formations. This latter effect is of particular concern in gas wells, where the formations may be physically weak and susceptible to collapse under the weight of a column of unfoamed treating fluid or cement.

Recently, methods have been developed to stimulate wells employing $CO_2$ as the primary treating fluid, with a relatively small proportion of another liquid or gel employed to transport additives or support proppants.

The prior art layout of equipment employed in operations such as are described above requires the use of a centrifugal or vane type booster pump and preferably a liquid/gas separator between the liquified gas tank and a primary pump. This equipment is required due to the heat gain in the line leading to the primary pump, which heat gain induces vapor lock in the line and prevents proper liquid intake into the primary pump, causing cavitation in the fluid end thereof and possible destruction of the pump itself. The vaporization problem increases as the gas is emptied from the tank, as the tank pressure drops with a consequential tendency toward vapor lock. The aforementioned booster pump and separator necessitates at least one additional trailer on site, as well as constant monitoring of the booster pump and a fairly high level of maintenance between jobs. On large jobs, several booster pump trailers may be required. In addition, the prior art booster pump becomes less effective at high tank pressures due to increased tendency of the fluid to form vapor.

SUMMARY OF THE INVENTION

In contrast to the booster pumps of the prior art, the passive booster of the present invention provides a relatively simple, compact apparatus and method of use thereof for reducing the temperature of liquified gas employed in a well treating fluid, thereby maintaining the gas in a liquid state while avoiding the need for a boost in liquified gas pressure in the feed line to the primary pump. The passive booster of the present invention comprises a heat exchanger, the tube side of which communicates with the main liquified gas feed line, and the shell side of which is supplied with liquified gas from the tube side through a variable orifice valve. In the case of $CO_2$, a back pressure valve is employed on the gas outlet vent from the shell side of the booster, to maintain pressure on the shell side at a high enough level to prevent solidification of the low temperature $CO_2$. An automatic control system to regulate liquified gas flow to the shell side of the booster may be employed, or flow may be manually regulated. In certain instances it may be desirable to employ a passive booster in series with a conventional booster pump to feed a primary pump, thus providing not only a temperature reduction but also a pressure increase to accommodate long feed lines, high flow rates, high ambient temperatures or a combination thereof.

BRIEF DESCRIPTION OF THE DRAWINGS

The passive booster of the present invention, its theory of operation and method in which it is used may be more fully understood by one of ordinary skill in the art by reference to the following detailed description of the preferred embodiments and their operations, taken in conjunction with the accompanying drawings, wherein.

DETAILED DESCRIPTION AND OPERATION OF THE PRIOR ART

Figure 1:
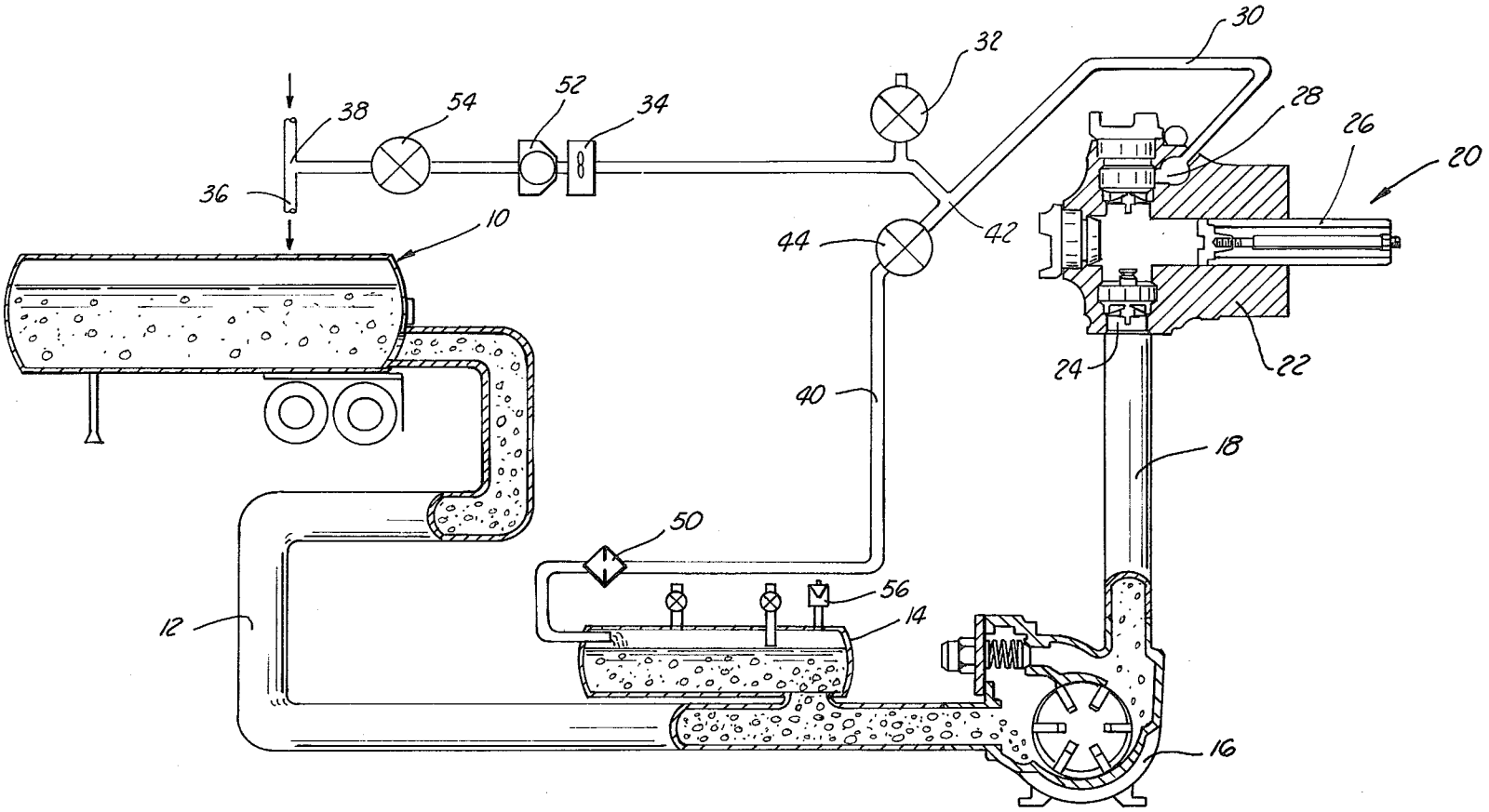
FIG. 1 PRIOR ART
FIG. 1 is a schematic of a prior art booster pump system for conveying a liquified gas from a source to a primary pump and to inject the gas in the stream of a treating fluid to be injected into an oil or gas well.

FIG. 1 of the drawings shows a prior art system of conveying a liquified gas to a primary pump used to inject the gas into a fluid stream used to treat an oil or gas well. Insulated tank trailer 10 is driven to the well site, and feed line 12 is attached thereto, to carry the liquid gas ($CO_2$ is used as an example and not by way of limitation) to a liquid/gas separator 14, then to booster pump 16, which is generally a centrifugal or vane type pump which may have an hydraulic or a direct drive. From booster pump 16, intake line 18 carries the liquified $CO_2$ to the fluid end 22 of a high pressure positive displacement type pump 20 (hereinafter referred to as the "primary" pump), generally a triplex pump driven by a diesel engine.

The liquified $CO_2$ enters the suction 24 of the fluid end 22 of the primary pump 20 on the intake stroke of pump plunger 26. On the compression stroke of plunger 26, suction 24 closes and outlet 28 opens to permit flow of the liquified gas into output line 30 having $CO_2$ vent 32 thereon. Flowmeter 34, is incorporated in output line 30 so that the flow of the liquified $CO_2$ may be monitored and adjusted relative to the flow of the treatment fluid in injection line 36, which output line 30 joins at tee 38. Flow of the treatment fluid is shown by arrows in conjunction with injection line 36. The term "treatment fluid" should be understood to encompass any fluid, gel or slurry with which the liquified gas is mixed for injection into the well. Of course, the injection line runs to the wellhead, to a wellhead isolation tool or to other manifolding which transmits the gas-laden treatment fluid to tubing in the well bore, all of which is well known in the art and therefore will not be further described herein. Also shown in FIG. 1 is return line 40 which runs from liquid/gas separator to tee 42 on output line 30, valve 44 being used to shut off back flow output line 30 when pump 20 is operating. Strainer 50 prevents contaminants from entering liquid/gas separator 14, and check valve 52 on output line 30 prevents back flow of liquified gas and/or treatment fluid from injection line 36. Valve 54 is employed to close off output line 30 when desired.

It should be understood that tank 10 may comprise a plurality of tanks, feed line 12 may be included in a manifold system leading to one or more booster pumps 16 and one or more primary pumps 20. However, for purposes of simplicity, all operations are described herein with reference to single components. Prior to the treating operation, the discharge valve of tank 10 is opened to bleed liquid $CO_2$ into feed line 12, liquid/gas separator 14 and booster pump 16. $CO_2$ vent 32 and valve 44 are opened to fill and cool primary pump 20. When carbon dioxide "snow" appears at vent 32, the lines are filled. If a bleedoff valve is included in fluid end 22, it is also opened to ensure complete filling of the pump cylinders. Booster pump 16 is started, and primary pump 20 put into operation gradually. Other primary pumps associated with the treatment fluid in injection line 36 are also on line, valve 32 is closed and valve 54 is opened to permit $CO_2$ flow into injection line 36.

In the treatment operation, liquid $CO_2$ is transported to the site in insulated tank 10 under a pressure of 250 to 350 psig and a temperature of $-10°$ F. to 7° F.; as the liquid $CO_2$ is drawn from tank 10 and liquid $CO_2$ in the tank vaporizes, the temperature and pressure in the tank drop. Feed line 12 takes $CO_2$ from tank 10 to booster pump 16, the $CO_2$ acquiring heat from the environment therebetween. Since the acquired heat may cause a portion of the $CO_2$ to vaporize if the well site is at a high ambient temperature, liquid/gas separator 14 should be placed in feed line 12 before booster pump to remove some of the $CO_2$ vapor phase. Separator 14 essentially comprises a pressure vessel with return line 40 leading to output line 30. Relief valve 56 relieves $CO_2$ into the atmosphere from separator 14 if pressure therein exceeds a predetermined level.

Liquid $CO_2$ with some of the vapor removed therefrom is fed into booster pump 16, which increases the pressure thereof 50 to 125 psi above that in feed line 12 to counter the heat input from the environment. The pressure increase raises the temperature at which the $CO_2$ forms a vapor phase, and thus tends to inhibit vapor lock at suction 24 of fluid end 22. Fluid end 22 of pump 20 then takes the $CO_2$ feed from inlet line 18, raises its pressure, 2,000 psi to 10,000 psi or more, and outlet line 30 takes the high pressure liquified $CO_2$ to injection line 36, where it mixes with the treatment fluid therein and is subsequently injected into the well.

The prior art booster pump system disclosed in FIG. 1 works with a self-defeating phenomenon, e.g. it raises the pressure of the liquified gas in order to maintain it in a liquid state while adding heat thereto which causes the needed pressure increase to become even greater.

Figure 2:
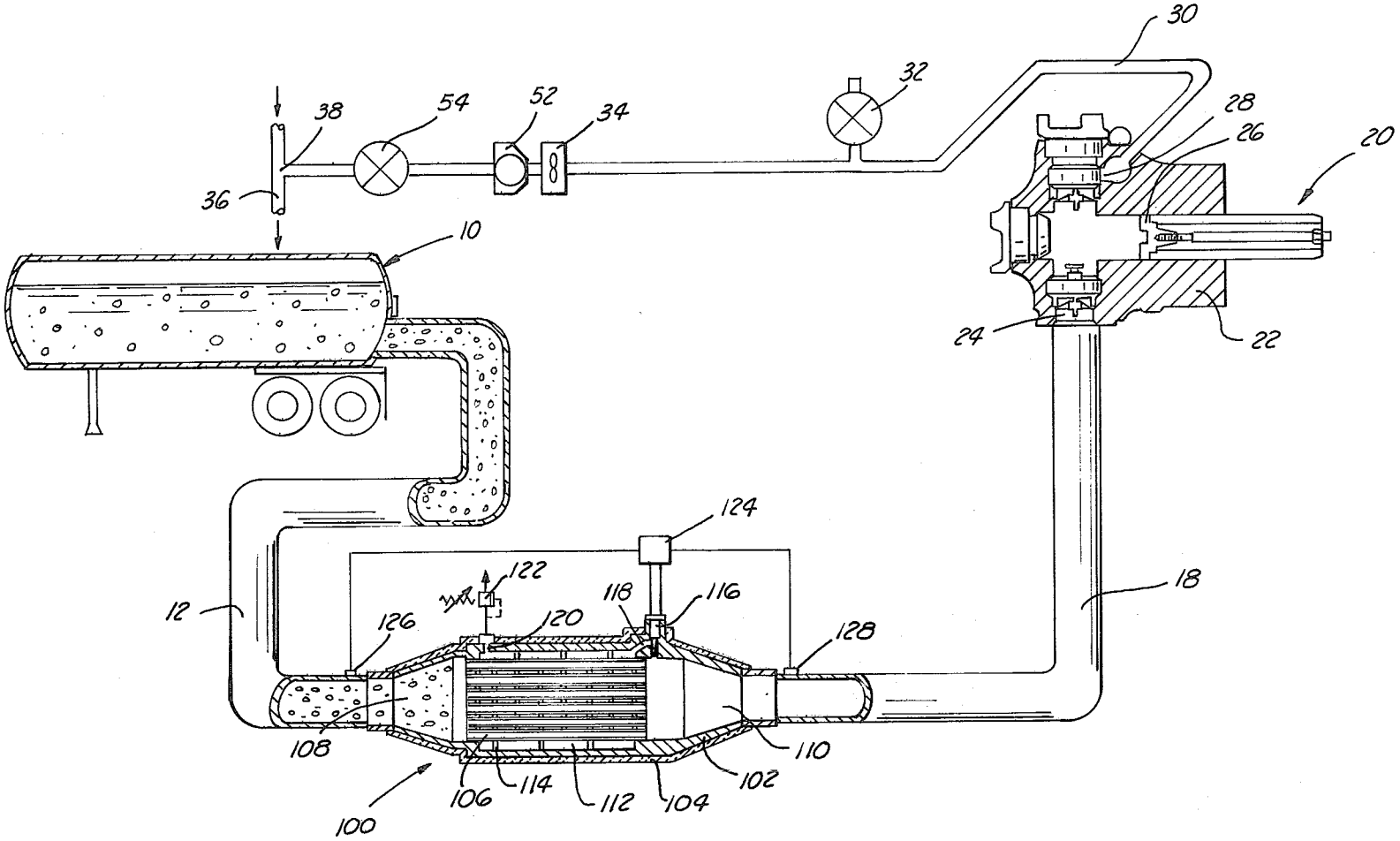
FIG. 2 is a schematic similar to FIG. 1 showing the preferred embodiment of the passive booster system of the present invention employed in lieu of the booster pump system of the prior art.

Referring now to FIG. 2 of the drawings, the preferred embodiment of the passive booster system of the present invention is shown. As in the prior art system, liquified $CO_2$ is brought to the well site in tank trailer 10. However, in lieu of liquid/gas separator 14 and booster pump 16, passive booster 100 is placed in gas feed line 12.

Passive booster 100 comprises a tube and shell type heat exchanger including pressure vessel 102 surrounded by insulating material 104, and a plurality of tubes 106 running through pressure vessel 102. The interiors of tubes 106 extend between inlet chamber 108 and outlet chamber 110 of the passive booster 100. Inlet chamber 108, outlet chamber 110 and the interiors of tubes 106 are isolated from cooling chamber 112 extending between and surrounding tubes 106, except as noted below. A plurality of baffles 114 support tubes 106 and disperse flow in cooling chamber 112 as will be further described hereinafter. Passive booster 100 is an extremely compact device, which may be eight feet or less in length and from substantially ten inches to substantially twenty inches in diameter, depending upon desired flow capacity and cooling capability.

Variable orifice throttling valve 116 is positioned at the mouth of inlet passage 118 to cooling chamber 112, which mouth opens on outlet chamber 110. Throttling valve 116 controls $CO_2$ flow to cooling chamber 112, and through the Joule-Thomson Effect associated with the flow of a fluid from a higher pressure region to a lower pressure region through a constricted passage, the throttled $CO_2$ entering cooling chamber 112 is reduced in temperature. This cooled $CO_2$, which is in a mixed liquid and vapor phase, acts through the walls of tubes 106 to cool the main $CO_2$ flow through passive booster 100. Baffles 114, half of which extend downward from the top of pressure vessel 102 and half of which extend upward from the bottom of pressure vessel 102, ensure a serpentine $CO_2$ flow pattern from inlet passage 118 through cooling chamber 112 to outlet 120, which terminates in back pressure valve 122. Back pressure valve 122 should be set to ensure a back pressure of at least 70 psig, to prevent solidification of $CO_2$ in the cooling chamber. Suitable back pressure valves are commercially available and well known in the art.

An automatic throttling valve control 124 may be incorporated in passive booster 100 if desired. The control may work in several ways. For example, probes 126 and 128 may be employed to measure the temperature at the inlet and outlet ends of passive booster 102, so that throttling valve control 124 modulates $CO_2$ flow into cooling chamber 112 in response to a temperature differential between the readings of probes 126 and 128, in order to provide sufficient cooling for the $CO_2$ in passive booster 100 to prevent vapor lock at pump 20, while ensuring that the $CO_2$ flow through the cooling chamber 112 is not excessive.

An alternative monitoring approach to throttling valve control 124 involves the use of probe 126 to measure $CO_2$ pressure at the passive booster inlet end instead of temperature and probe 128 to measure $CO_2$ temperature at its outlet end. In this instance, $CO_2$ pressure in feed line 12 is measured by probe 126, and $CO_2$ flow into cooling chamber 112 is modulated by throttling valve 118 to reduce the measured temperature at probe 128 to ensure sufficient cooling of the $CO_2$ in passive booster 100 to avoid vapor lock at the measured pressure (allowing for further heat gain in inlet line 18 leading to primary pump 20), while avoiding excessive $CO_2$ flow through cooling chamber 112.

At the well site, passive booster 100 is employed in lieu of a booster pump. The tank 10 discharge valves are opened and $CO_2$ bled into feed line 12 through passive booster 100 and into inlet line 18 as $CO_2$ vent 32 on the downstream side of primary pump 20 is opened to allow liquid $CO_2$ to completely fill feed line 12, inlet line 18 and passive booster 100. If a bleedoff valve is incorporated in fluid end 22, it is also opened to ensure complete filling of the pump cylinders.

In the treating operation, flow is begun from tank to primary pump 20, the temperature of the $CO_2$ passing through passive booster 100 from feed line 12 to intake line 18 being maintained at a low enough level to avoid vapor lock at pump suction 24. The $CO_2$ is then raised in pressure by primary pump 20 and conveyed to injection line 36 by output line 30 as heretofore described with respect to FIG. 1.

By way of example, a field test was conducted at Duncan, Okla. to test the characteristics of an eight foot long by twelve inch diameter passive booster. At a $CO_2$ flow rate of 1.5 barrels per minute, the passive booster lowered $CO_2$ temperature in the line 20° F., which is equivalent to boosting pressure 96 psi, or approximately 77 to 192 percent of the boost available with prior art booster pumps as heretofore described. Approximately thirteen percent of the $CO_2$ flow was consumed by the passing booster in cooling the remainder. During another part of the aforementioned test, the passive booster lowered $CO_2$ temperature in the line 28° F., equivalent to a 135 psi boost, or approximately 110 to 270 percent of prior art booster pump capability.

It should be noted that the passive booster of the present invention will, unlike the booster pumps of the prior art, effect a certain change in the enthalpy of the $CO_2$ regardless of the ambient temperature at the well site. This is in contrast to the booster pump, which became less effective as the ambient temperature and correspondingly the tank pressure increase, due to the heat input to the $CO_2$.

Figure 3:
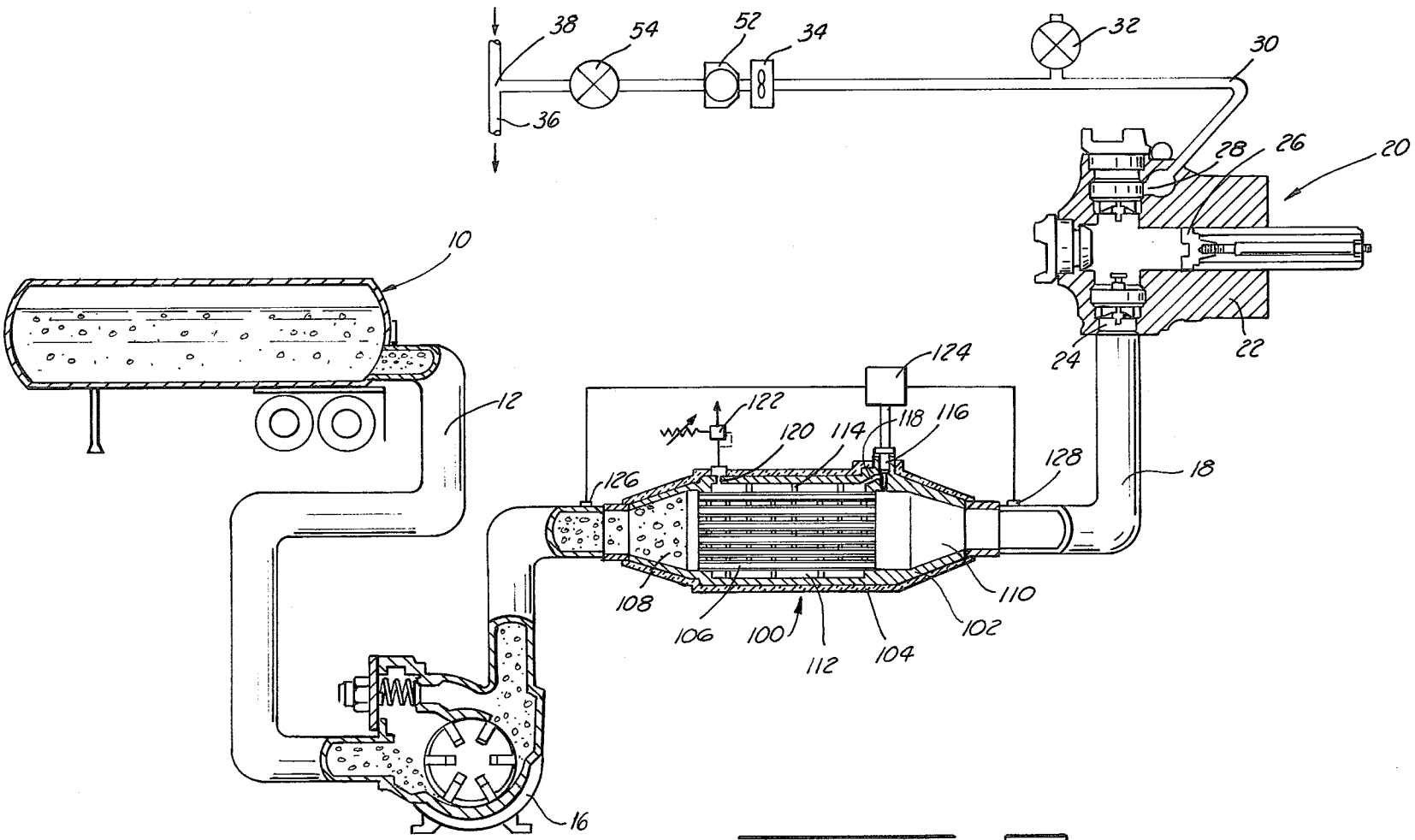
FIG. 3 is a schematic similar to FIG. 1 showing an alternative embodiment wherein the passive booster system of the present invention is utilized with the booster pump of the prior art.

Referring now to FIG. 3 of the drawings, passive booster 100 is depicted in series with a booster pump 16 of the prior art. As all the components depicted in FIG. 3, and their operation, have been previously described, a detailed description thereof will not be repeated. However, the absence of liquid/gas separator 14 and its associated plumbing should be noted.

In operation, liquid $CO_2$ from tank 10 is first raised in pressure in booster pump 16, and then cooled in passive booster 100. This procedure provides a notable advantage, as not only is the $CO_2$ pressure in the lines raised, but the associated cooling negates the heat input of the booster pump 16 as well as providing additional equivalent boost.

Figure 4:
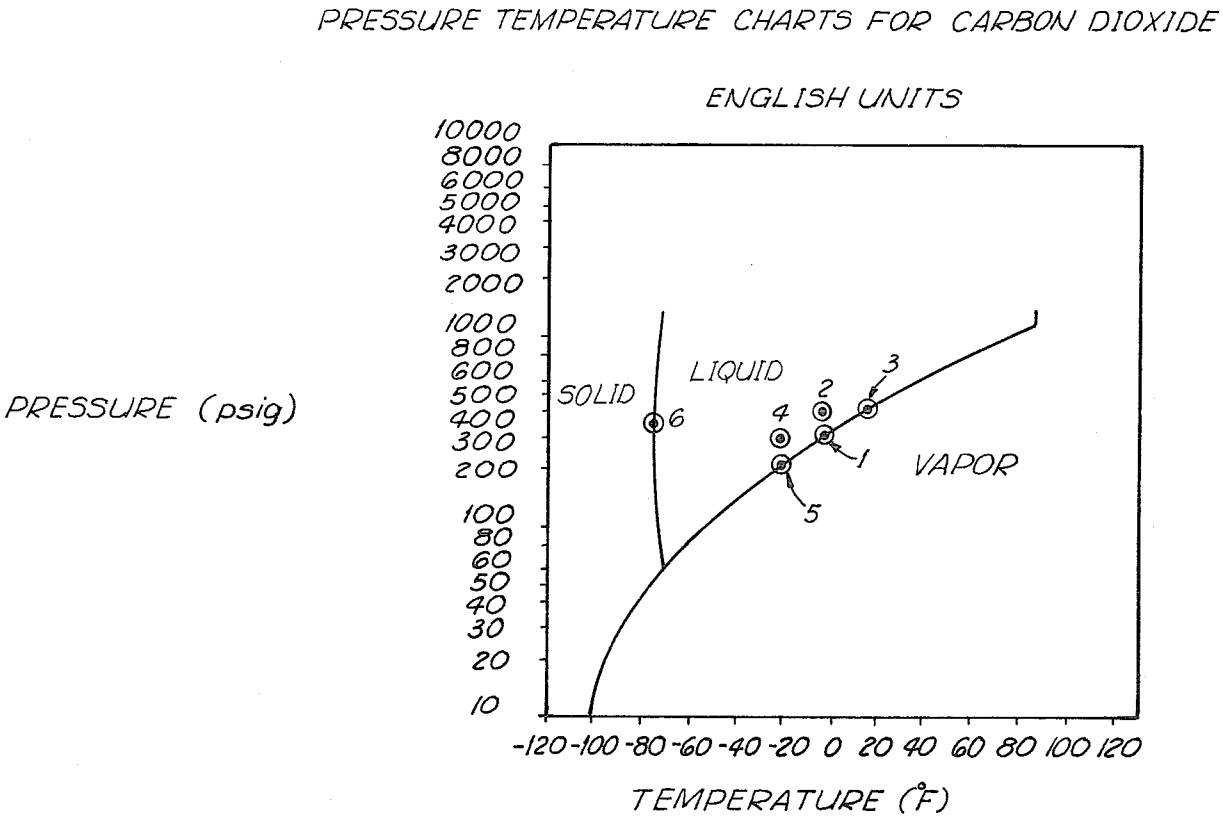
FIG. 4 is a pressure versus temperature chart for carbon dioxide.

Referring now to FIG. 4 of the drawings, a pressure versus temperature chart for carbon dioxide, the principle of operation of the passive booster of the present invention may be graphically illustrated. Assume that liquid $CO_2$ in a supply tank is at approximately 300 psig and −4° F., noted at point 1 on FIG. 4 on the liquid/vapor phase change line. The operator may employ a prior art booster pump to increase pressure 100 psi to 400 psig (point 2). As can easily be seen on FIG. 4, a 100 psi pressure increase removes the $CO_2$ 18° F. from the liquid/vapor phase change line (point 3), or an equivalent of an 18° F. temperature reduction which could be effected by the passive booster of the present invention. Point 4 illustrates an alternative 18° F. passive booster temperature reduction, which removes the $CO_2$ 100 psi from the liquid/vapor phase change line (point 5) or an equivalent of a 100 psi pressure boost.

FIG. 4 also illustrates the maximum temperature reduction which may be effected by the passive booster at a given pressure; this, of course is limited by the solidification temperature of $CO_2$ at a particular pressure.

As shown in FIG. 4, one may achieve a maximum temperature drop of 73° F. in the $CO_2$ with the $CO_2$ supply at 350 psi before the $CO_2$ solidifies (point 6). This would be equivalent to a pressure boost of 280 psi, a surprising and unexpected result. The maximum possible equivalent boost is reduced as the pressure in the liquid $CO_2$ tank diminishes as it is drawn off and the temperature in the tank decreases as the vapor state $CO_2$ expands. Of course, the maximum temperature reduction effected at a given pressure in the tube side of passive booster is dependent upon the length, diameter, design and materials employed in the device, as well as $CO_2$ flow rate therethrough, all of which affect the tube side to shell side heat transfer.

Thus there has been described a novel and unobvious apparatus and method for conditioning carbon dioxide and other gases used in treatment of oil and gas wells. Because a passive booster of adequate capacity may be carried on a primary pump trailer, the advantage of using the apparatus of the present invention in lieu of a booster pump is quite obvious. In addition, the low required maintenance level and automatic operation in comparison to the prior art booster pumps constitute additional advantages. Numerous additions, deletions and modifications to the preferred embodiments of the method and apparatus of the present invention will be readily apparent to one of ordinary skill in the art. For example, heat exchanger designs other than tube and shell may be employed as a passive booster, the passive booster may be placed in the line to the primary pump before a booster pump, or a single temperature could be monitored at the passive booster to simply maintain outlet gas temperature below a given level. In addition, gas may be fed into the shell or low temperature side of the heat exchanger directly from the gas source, rather than from another part of the heat exchanger. One gas could be employed in the high temperature (tube side) of the heat exchanger as a well treatment fluid and a second, different gas employed in the shell side to cool the first. Furthermore, while the foregoing specification refers to "liquid" gas, and to "vapor" gas, one of ordinary skill in the art will appreciate that liquid gas may have some vapor within, being only substantially liquified and vapor may have liquid particles therein, being only substantially vaporized. There also may be many other combinations of partial liquid and partial vapor within systems such as have been described in the specification at any given time, and the specification has not attempted to exclude their existence by failure to comment thereon, nor imply that the method and apparatus of the present invention is workable only with completely liquid and completely vapor states of a gas.

I claim:

1. An apparatus adapted to inhibit vaporization of a pressurized substantially liquified gas of the type employed in treatment of oil and gas wells, comprising:

heat exchanger means adapted to receive and discharge a flow of said substantially liquified gas from a liquified gas source at a well site;

tube side means associated with said heat exchanger means adapted to conduct at least substantially most of said flow of said substantially liquified gas through said heat exchanger means;

shell side means associated with said heat exchanger means in heat transferring communication with said tube side means and variable throttling valve means adapted to lower the temperature of at least partially liquified gas introduced into said shell side means below that of said substantially liquified gas flow through said tube side means.

2. The apparatus of claim 1, wherein said shell side means receives said at least partially liquified gas through inlet passage means associated with said variable throttling valve means from said flow through said heat exchanger means.

3. The apparatus of claim 1, wherein said variable orifice throttling valve means includes probe means adapted to measure at least one temperature of said flow through said heat exchanger means and control means adapted to vary the rate of entry of said gas into said shell side means in response to said temperature measurement.

4. The apparatus of claim 3, wherein said probe means measure inlet temperature and outlet temperature of said flow through said heat exchanger means, and said control means is adapted to vary said rate of entry in response to the temperature differential therebetween.

5. The apparatus of claim 3, wherein said probe means measures inlet pressure of said flow through said heat exchanger means and said at least one measured temperature is outlet temperature of said flow through said heat exchanger means, and said control means is adapted to vary said entry rate in response to said measured inlet pressure and outlet temperature.

6. The apparatus of claim 1, wherein said gas is carbon dioxide, and said shell side means includes back pressure valve means to maintain gas pressure in said shell side means above substantially 70 psi.

7. The apparatus of claim 1, wherein said gas is nitrogen.

8. The apparatus of claim 1, further including centrifugal pump means in series with said heat exchanger means.

9. The apparatus of claim 8, wherein said centrifugal pump means is placed between said heat exchanger means and said source of said gas flow.

10. A pressure boost system for a liquified gas employed in treatment of oil and gas wells, comprising:

a source of substantially liquified gas;

primary pump means adapted to substantially increase the pressure of said substantially liquified gas prior to said treatment; and heat exchanger means incorporated in a flow line conducting a flow of said substantially liquified gas from said gas source to said primary pump means and including throttling valve means adapted to reduce the temperature of said substantially liquified gas flow therethrough.

11. The apparatus of claim 10, wherein said heat exchanger means comprises tube side means and shell side means, said flow is through said tube side means and said temperature reduction of said flow is effected by reducing the temperature in said shell side means with said throttling valve means and transferring heat from said tube side means to said shell side means.

12. The apparatus of claim 11, further including centrifugal pump means in said flow line between said gas source and said primary pump means.

13. The apparatus of claim 12, wherein said centrifugal pump means is located in said flow line between said gas source and said heat exchanger means.

14. A method of inhibiting vaporization of a substantially liquified gas of the type employed in treatment of oil and gas wells, comprising:

receiving said substantially liquified gas from a gas source at a well site;

reducing the temperature of said substantially liquified gas by employing a minor portion thereof to reduce the temperature of the major portion thereof; and discharging said reduced temperature major portion for use in said well treatment.

15. The method of claim 14, further including the step of raising the pressure of said substantially liquified gas.

16. The method of claim 14, wherein said temperature reduction of said major portion of said substantially liquified gas is effected by reducing the temperature of said minor portion and transferring heat from said major portion to said minor portion.

17. The method of claim 16, wherein said temperature reduction of said minor portion is achieved by throttling said minor portion.

18. The method of claim 17, wherein said minor portion is throttled into a chamber in heat transferring relationship with said major portion.

19. The method of claim 18, wherein the rate of throttling of said minor portion is controlled in response to at least the temperature of said major portion.

* * * * *